United States Patent [19]

Saito

[11] Patent Number: 4,537,485

[45] Date of Patent: Aug. 27, 1985

[54] AUTOMATIC DEVELOPING MACHINE

[75] Inventor: Kaneo Saito, Hino, Japan

[73] Assignee: Konishiroku Photo Industry Co., Ltd., Tokyo, Japan

[21] Appl. No.: 543,823

[22] Filed: Oct. 20, 1983

[30] Foreign Application Priority Data

Oct. 25, 1982 [JP] Japan ..... 57-188015

[51] Int. Cl.[3] ..... G03D 5/02

[52] U.S. Cl. ..... 354/304; 354/318

[58] Field of Search ..... 354/303, 304, 305, 313, 354/314, 317, 318; 352/130

[56] References Cited

U.S. PATENT DOCUMENTS

| | | | |
|---|---|---|---|
| 3,608,454 | 9/1971 | Shenk | 354/301 |
| 4,371,249 | 2/1983 | Czumak | 354/318 |
| 4,375,324 | 3/1983 | Holmes | 354/318 |
| 4,452,523 | 6/1984 | Douglas | 354/318 |

*Primary Examiner*—A. A. Mathews

*Attorney, Agent, or Firm*—James E. Nilles; Thomas F. Kirby

[57] ABSTRACT

An automatic developing machine for photosensitive material wherein an exposed photosensitive material and a guide web received a processing agent are wound on a winding shaft in a superposed state, and the guide web and the photosensitive material are rewound when a predetermined time period elapses after a completion of winding of the photosensitive material and the guide web in a dark box.

6 Claims, 10 Drawing Figures

AUTOMATIC DEVELOPING MACHINE

BACKGROUND OF THE INVENTION

1. Field of the Invention:

This invention relates to an automatic developing machine in which a development is performed in a short time period by a method wherein a photosensitive material such as a film or photographic printing paper wound in a roll is brought into contact with jellylike processing agent.

2. Description of the Prior Art:

In general, the processing of a photosensitive material includes several steps such as development, fixing, washing, drying and the like, therefore a large size of processing machine and a large amount of processing time are required.

In order to counter this, a so-called instant photosensitive material and processing agent have been developed. The processing agent of this type is jellylike, which eliminates the steps of washing and drying out of the conventional process as above. This invention relates to the automatic developing machine of this type.

As is well known, a processor generally has so high a reducing force that it is kept in a sealed bag until it is ready to use. The jellylike processing agent employed in this invention is not an exception. Immediate before used, the processor bag is opened only in a small pouring hole. Then the processor is squeezed out on the surface of the photosensitive material to be developed forming a uniform distribution. This uniform distribution of the processor, however, is very difficult particularly to an elongated photosensitive material.

SUMMARY OF THE INVENTION

A primary object of this invention is to provide an automatic developing machine to perform an automatic development of an even image from an elongated photosensitive material. This object can be achieved by the automatic developing machine characterized in that a jelly processor is coated on a guide web, which is wound on a winding shaft driven by a motor installed in a dark box together with a roll of exposed photosensitive material in the dark box, and rewound by the motor after a certain time period.

Other objects and advantages of this invention will become apparent in the proceeding of the detailed description of the invention with reference to the accompanying drawings.

BRIEF DESCRIPTION OF THE INVENTION

FIG. 9(*b*) is a perspective view of enlarged light emitting portion and light receiving portion thereof.

DESCRIPTION OF THE PREFERRED EMBODIMENTS

Figure 1:
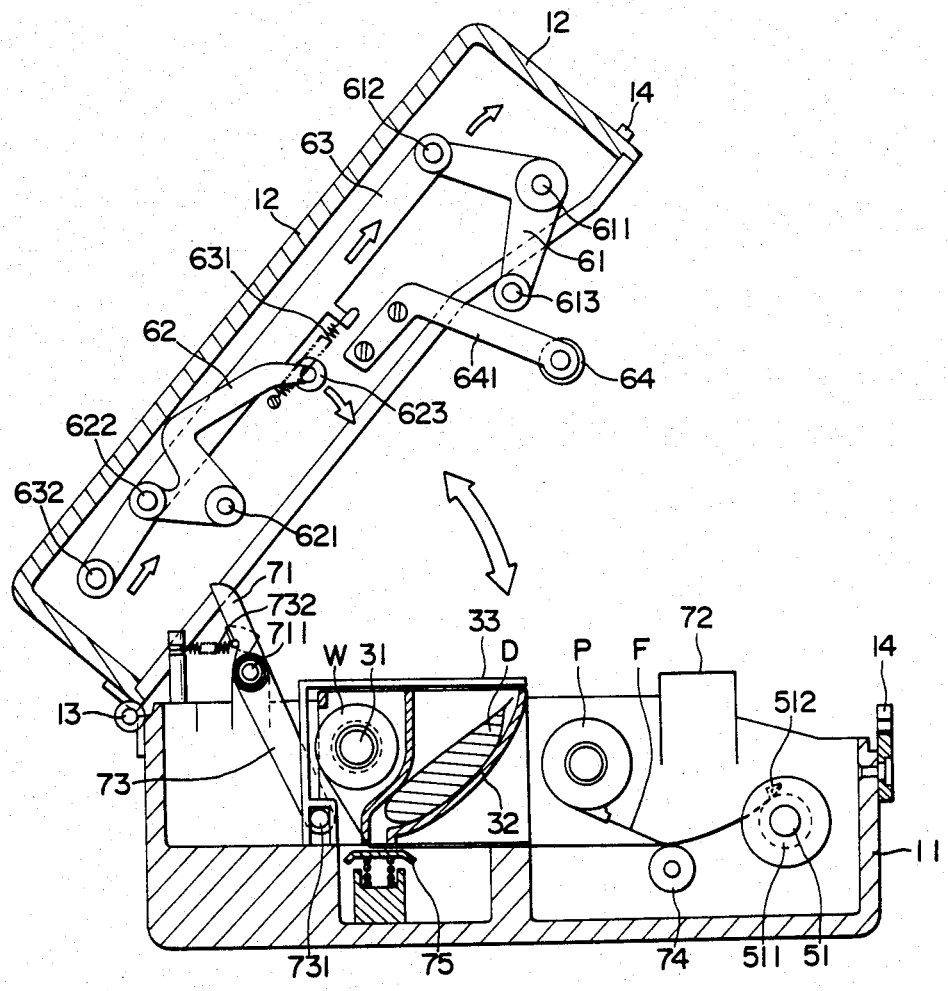
FIG. 1 is a cross section of the automatic developing machine according to an embodiment of this invention, with a lid cover open.

Numeral 11 denotes a machine body and 12 denotes a lid cover, both made of a lignt impermeable material. The lid cover 12 is closable with respect to the machine body 11 around a hinge 13 and retained in a closed condition by means of a stop metal 14. At the joint part of the machine body 11 and cover 12, an appropriate engagement means such as convex-concave engaging member or groovelike engaging member is formed to engage with each other fitably. In the lid cover closed condition, the machine body 11 and lid cover 12 form a dark box, in which the developing process is carried out.

In the operation, at first photosensitive material, guide web and processor are disposed in place while keeping the lid cover 12 opened.

In this instance, the photosensitive material is a roll of exposed film F, which is housed in a cartridge P, with the bare tip end. Without saying, the photosensitive material may be a rolled photograph printing paper. The cartridge P is mounted in the machine body to engage a cartridge shaft 21 installed fixedly in the body 11.

Figure 6:
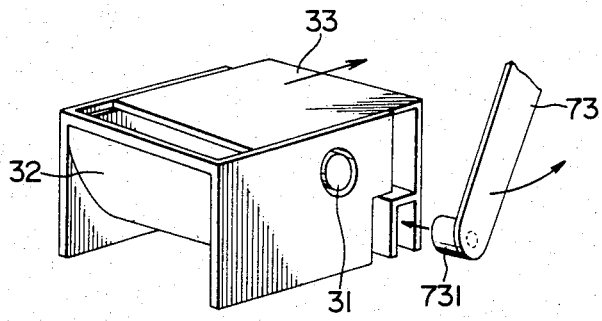

A jelly processor D is contained sealingly in a flexible bag with an opening openable with a slight pressure. A guide web W is a paperlike substance slightly longer than the rolled film F and wound around a web shaft 31. The processor D and guide web W constitute a unit, which is housed in a little box 32 shown perspectively in FIG. 6. This little box 32 has a closable lid cover 33 which moves in the leftward and rightward directions. The little box 32, with processor D and guide web W disposed therein and the lid cover 33 closed, is placed at its position within the machine body 11. At this time, the web shaft 31 of the little box 32 engages with a web rewinding shaft 41.

Then the tip end of the guide web W and that of the rolled film F are drawn out to mount on a winding shaft 511 provided in the machine body 11. In this particular embodiment, on the periphery of the winding shaft 511 a hook 512 is provided for hanging thereon the tip ends of the guide web W and rolled film F. Of course, any other suitable mounting method may be taken, for example, gripping, dropping or automatic loading.

Figure 3:
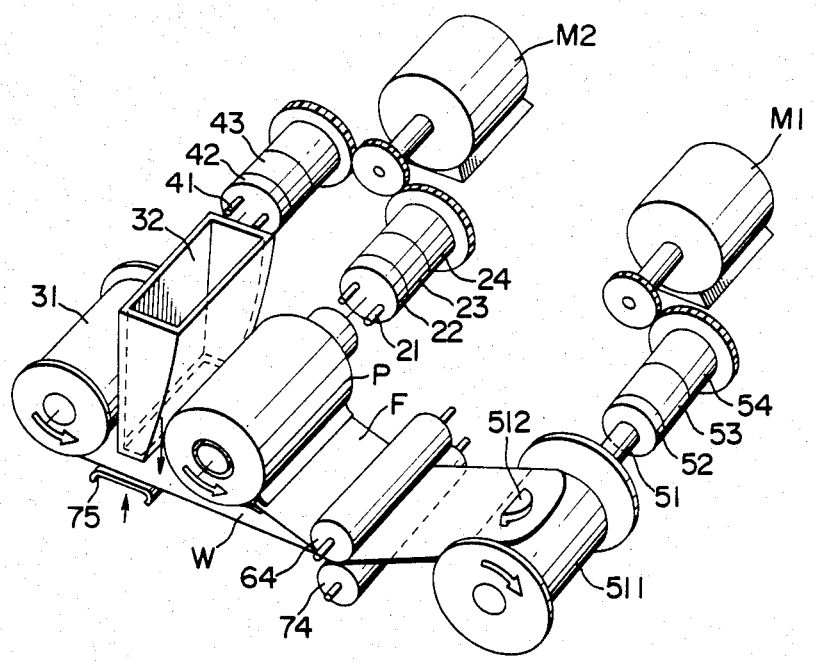
FIG. 3 is a perspective view of an important part of the machine shown in FIG. 1.

In FIG. 3, an important part of the driving system for a winding shaft 51 mounted in the machine body 11, cartridge shaft 21 and web rewinding shaft 41 is shown. In this figure, symbol M1 denotes a winding motor for the winding shaft 51 and symbol M2 a rewinding motor for the cartridge shaft 21 and web rewinding shaft 41. Though two motors are employed in this embodiment, a single and the same motor can be used for the both winding and rewinding functions if equipped with necessary converting devices to obtain various rotations. If the motor is housed within the winding shaft or elsewhere in a suitable place, the unit can be reduced to a very compact size.

Numeral 52 denotes a joint to transmit the rotation of the winding motor M1 to the winding shaft 51. Also, numerals 22 and 42 are joints to transmit the rotation of the rewinding motor M2 to the cartridge shaft 21 and web rewinding shaft 41 respectively.

Numerals 23 and 43 designate one-way clutches to permit the cartridge shaft 21 and web rewinding shaft 41 to idle in the direction indicated by an arrow, and numeral 53 denotes another one-way clutch to permit the winding shaft 51 to idle in the reversed direction to the arrow indicated direction.

Numerals 24 and 54 are parts of detecting completion of winding or rewinding of the web, for example, by means of detecting an overloading state, so that a switch or electric contact is changed over.

The overload detection will be described later in more detail.

Figure 5:
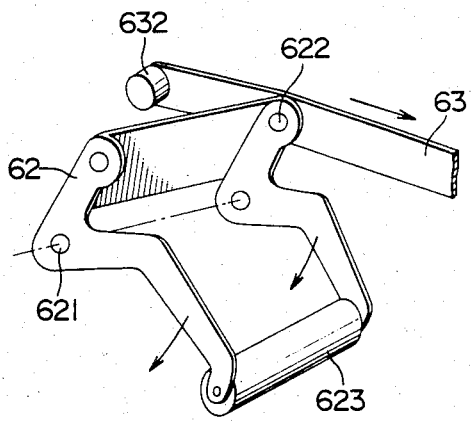

Inside the lid cover 12, two levers 61 and 62, using shafts 611 and 621 provided on the lid cover 12 as their rotary shafts, constitute a linkage together with another lever 63 through shafts 612 and 622. The lever 63 is normally being pulled leftward by a spring 631, one end of which is fixed on the lid cover 12. At one end of the lever 63, a roller 632 is provided to contact a lever 71 provided in the machine body 11 when the lid cover 12 is closed. Similarly at one end of the lever 61, a roller 613 is provided to contact a contact part 72 provided in the machine body 11 when the lid cover 12 is opened. At one end of the lever 62, as is best shown in the perspective view of FIG. 5, a roller 623 is provided for pressing and spreading the processing agent D.

Figure 4:
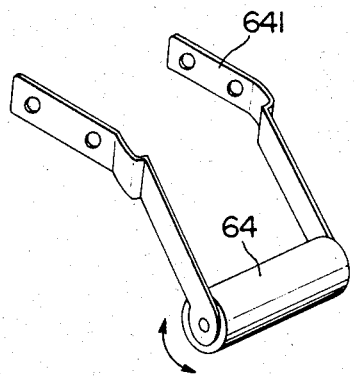
FIGS. 4 to 6 are perspective views of respective parts employed in the machine.

Inside the lid cover 12, a further lever 641 is additionally provided as shown in the perspective view of FIG. 4, the tip end of which is formed with a roller 64. This roller 64 is brought into contact with a roller 74 provided in the machine body 11 upon closing the lid cover 12. In this instance, the rolled film F and guide web W are positioned to be gripped between these rollers 64 and 74.

Two levers 71 and 73 provided in the machine body 11 are rotatable around a single and the same shaft 711. The lever 73 is biased by a spring 732 in the counterclockwise direction, and the lever 71 is biased by a spring 712 in the direction superposing on the lever 73 biasing direction. The lever 73 has a protrusion 731 at one end, which engages with the lid cover 33 of the little box 32, when the box 32 is put in place in the machine body 11.

Figure 2:
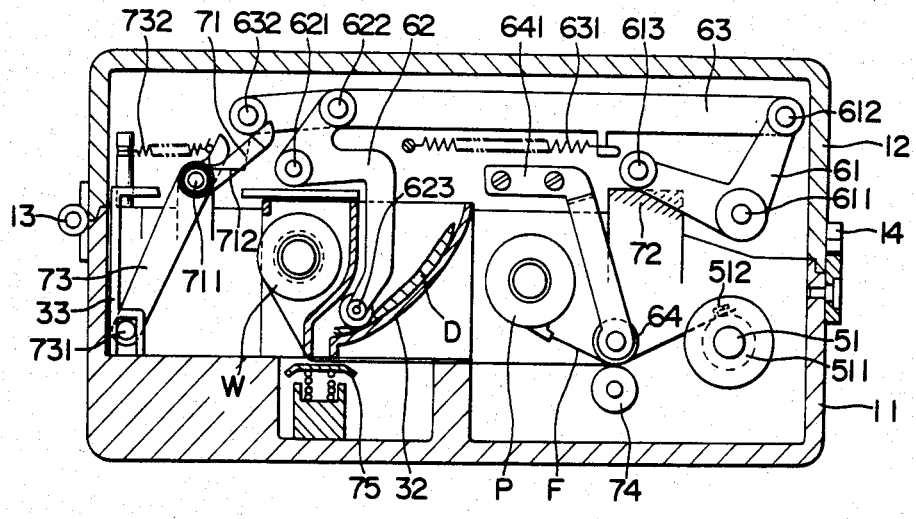
FIG. 2 is a cross section of the machine shown in FIG. 1, with the lid cover closed.

In assembling, at first the cartridge P and little box 32 are set in place in the machine body 11, with the lid cover 12 kept open, and then the guide web W and rolled film F are mounted at the tip end on the winding shaft 511, and finally the lid cover is closed. Thus the state of the machine is transferred from FIG. 1 to FIG. 2. Explaining in more detail, the roller 613 provided in the lid cover 12 contacts intimately with the contact part 72 of the machine body 11, and the lever 61 rotates in the clockwise direction. The lever 63 linked with the lever 61 through the shaft 612 moves rightward, to bring the roller 632 into contact with the lever 71. Accordingly, the lever 73 is made to rotate in the clockwise direction through the operations of the springs 712 and 732, so that the lid cover 33 of the little box 32 is opened.

Accompanying the rightward movement of the lever 63, the lever 62 rotates in the clockwise direction, the roller 623 of which is driven to press the bag containing processing agent D. Under the pressure of the roller 623, the opening part of the bag is broken to discharge the processing agent D downward on the guide web W on a pressure plate 75 provided on the machine body 11 side.

The roller 64 comes into contact with the roller 74 on the machine body 11 side by the closing the lid cover 12. In this instance, the rollers 64 and 74 sandwich the superposed rolled film F and guide web W therebetween.

After a completion of the lid cover 12 closing, a development button R provided on the outer surface of the machine is pushed by hand, thereby starting the developing process of the film F.

Figure 7:
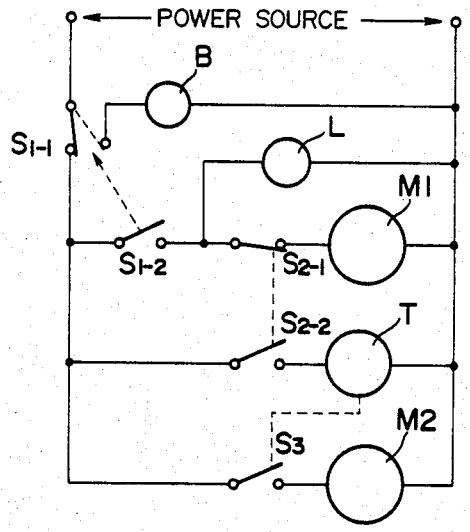
FIG. 7 is an electric circuit diagram included in the machine.
Figure 8:
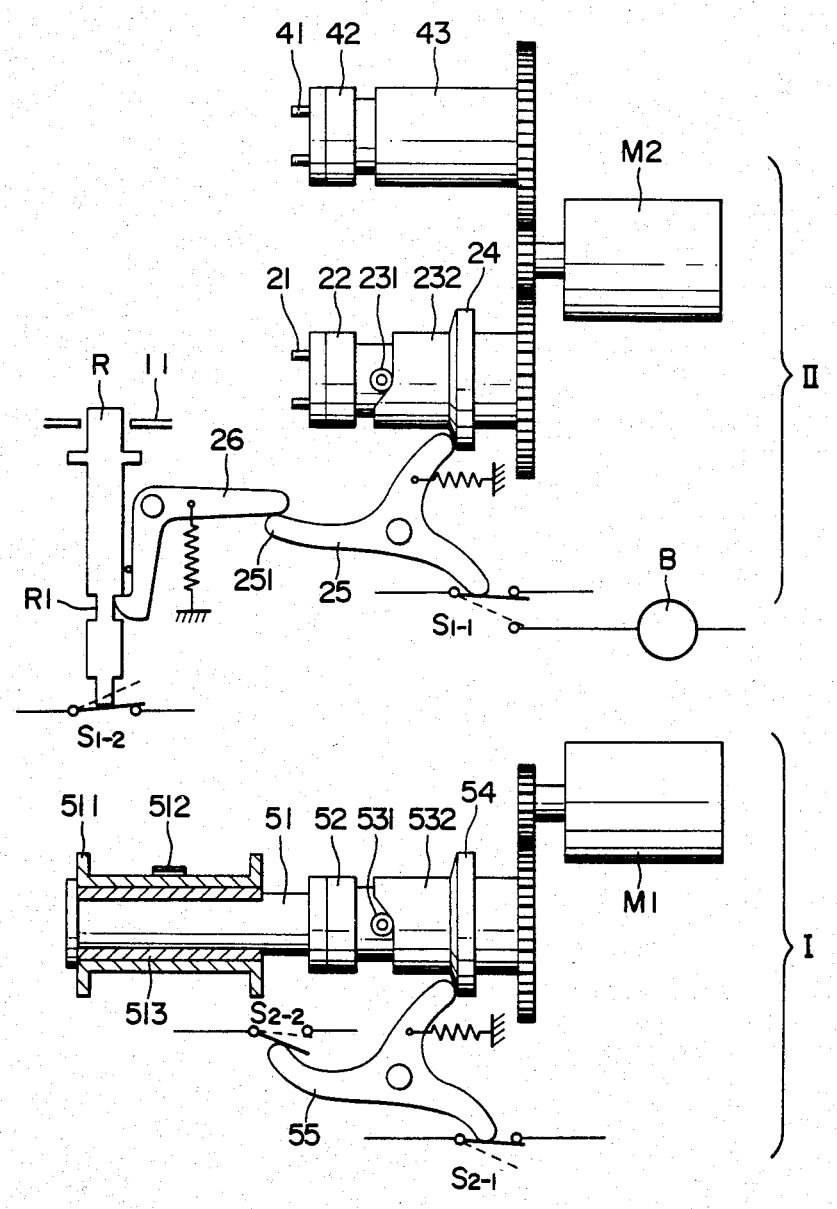
FIG. 8 is a perspective view of a related mechanism of the machine.

FIG. 7 shows a basic electric circuit included in the machine, and FIG. 8 shows a related mechanism of the electric circuit of FIG. 7.

Now, if the development button is pushed, a switch $S_{1-2}$ is turned ON to start the rotation of the winding motor M1. By the rotation of the winding shaft 511, the guide web W coated with the processing agent D on the surface and the roll of exposed film F are transferred into the gripping by the rollers 64 and 74 as contacted with each other intimately, and wound around the winding shaft 511 as they are.

On the other hand, a display lamp L to indicate that the machine is in operation is lighted.

The depressed development button R is kept in the depressed state by an engaging pawl 26 inserted into a recess R1 formed on the button.

When the rolled film F with one end fixed within the cartridge P is wound up by the winding shaft 511, the rolled film F and guide web W are halted in the stretched state. Accordingly, the winding power transmitting system is overloaded and slips. Then a roller 531 which serves as the overloading detecting mechanism, as illustrated in FIG. 8, is ridden over a cam cylinder 532 to move a flange 54 rightward, thereby turning a switch member 55 biased by a spring in the clockwise direction, so as to turn OFF a switch $S_{2-1}$ while turning ON another switch $S_{2-2}$. As the switch $S_{2-1}$ becomes OFF, the winding motor M1 stops. On the other hand, with the switch $S_{2-2}$ turning ON, a timer T starts counting. Between the reel 511 and the winding shaft 51, a friction member 513 is interposed. The frictional torque of this friction member 513 is adjusted to be stronger than the torque detected of the overloaded winding shaft 51.

Figure 9A:
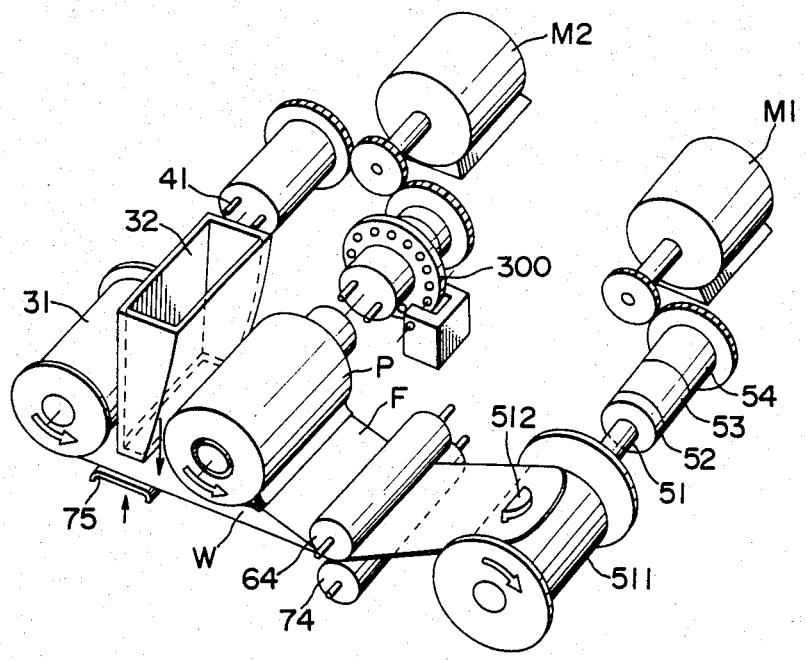
FIG. 9(*a*) is a perspective view of an important part of the machine of another embodiment of this invention.
Figure 9:
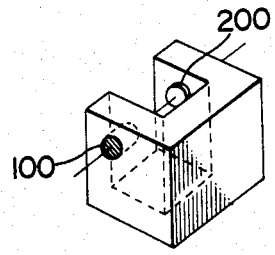

The completion of the winding by the winding shaft 51 may be detected by any other suitable means, for example, by the use of a rotation stop detecting mechanism such as an encoder. An example using an encoder is shown in FIG. 9(*a*) and FIG. 9(*b*). FIG. 9(*b*) shows an enlarged light emitting portion 100 and a light receiving portion 200. The light emitted from the light emitting portion 100 is received as pulses of light by the light receiving portion 200 according to the rotation of a circular plate 300 having through holes.

During the operation of the timer T for a predetermined time period, the development of the film F proceeds while keeping the film F wound around the winding shaft 511.

After an elapse of the predetermined time period of the timer T, a switch $S_3$ becomes ON to start the rewinding motor M2, which rewinds the developed film F and guide web W respectively by the rotation of the cartridge shaft 21 and web rewinding shaft 41.

At the end of the rewinding, the rolled film F and guide web W again halt in a stretched state. In this state, a cam cylinder 232 rides on a roller 231 which is the overloading detecting mechanism provided on the cartridge shaft 21, so as to move the flange 24 rightward. By this flange 24 movement, the swithch member 25 biased by a spring is turned clockwisely to change over a switch $S_{1-1}$. Thus the rewinding motor M2 stops and a buzzer B operates to inform a completion of developing process.

The clockwise rotation of a switch member 25 causes the engaging pawl 26 to turn in the counterclockwise direction, thereby disengaging the depressed development button R and returning it to its starting position. This also turns OFF the switch $S_{1-2}$ putting out the display lamp L.

Hearing the buzzer B informing the completion of the developing process of the film F, an operator opens the lid cover 12 and takes out the developed film F which has been rewound in the cartridge P and the little box 32 with its lid cover 33 closed. Thus, the automatic development of the film is entirely finished.

The little box 32 still contains the guide web W attached with the processing agent D and rewound up.

The buzzer B may be so designed as stop its informing function upon the opening of the lid cover 12, or after a predetermined time period elapses after the completion of the developing process by the use of a timer, irrespective of the opening of the lid cover 12.

As a power source of the electric circuit of the machine, either a domestic power source or a cell can be employed.

The overloading condition detecting device, though mechanical in this particular embodiment, may be electrically constituted, for example, by utilizing the phenomenon of flowing an overcurrent due to the overloaded condition of the motor.

The electric circuit shown in the diagram of FIG. 7 is only an illustrative example, and any other means, if appropriate for the above-mentioned purpose, can be used, for example, a control by means of a microcomputer.

It is further preferable to provide on the outer surface of the machine a handle of the timer T by which the developing process time can be controlled, for example, following a table prepared separatley, in accordance with the temperature conditions.

As described in the foregoing, the present invention can provide an automatic developing machine which is easy to operate without soiling the user's hands unnecessarily, compact in a portable size, and capable of providing a good development of the film.

What is claimed is:

1. A photographic developing machine comprising a light-tight housing (11);

a rotatable drum (511) within said housing; and winding means operable to wind onto said drum (511) a length of exposed photosensitive material (F) in area contact with a guide web (W) coated with a gelatinous processing agent (D) and to rewind the developed said photosensitive material (F) and the used guide web (W) from said drum (511) into respective individual locations (P,31);

characterized in that:

said winding means comprises electric motor means;

and by an overload detector (531,532,300) operable to detect an overload condition imposed on said electric motor means, said overload condition being representative of completion of a said winding operation onto said drum (511);

means (55,$S_{2-1}$, $S_{2-2}$) associated with said overload detector (531,532,300) and responsive to detection of a said overload condition to stop a said winding operation of said electric motor means and to start operation of a timer (T) to time a predetermined development time; and means ($S_3$) responsive to said timer (T) to initiate a said rewinding operation by said electric motor means after elapse of said predetermined development time.

2. A machine according to claim 1 including a second overload detector (231,232) operable to detect a second overload condition imposed on said electric motor means when re-winding, said second overload condition being representative of completion of a rewinding operation, and means (25,$S_{1-1}$) associated with said second overload detector (231,232) and responsive to detection of a said second overload condition to stop a said rewinding operation of said motor means and to operate an indicator (B) for indicating that development has been completed.

3. A machine according to claim 1 characterized in that said housing (11) comprises a first openable lid (12) and includes a smaller housing (32) which comprises a second openable lid (33), said smaller housing (32) receiving said guide web (W) when in an initially wound and when in a fully rewound condition and a supply of said gelatinous processing agent (D), and in that said first lid (12) is operable when moved to its closed position to effect opening of said second lid (33) to permit access from within said first housing (11) to within the smaller housing

4. A machine according to claim 1 or 5 or 3 characterized in that said electric motor means comprises a first electric motor (M1) operable to effect said winding operation and a second electric motor (M2) operable to effect said rewinding operation.

5. A machine according to claim 2, characterized in that said housing (11) comprises a first openable lid (12) and includes a smaller housing (32) which comprises a second openable lid (33), said smaller housing (32) receiving said guide web (W) when in an initially wound and when in a fully rewound condition and a supply of said gelatinous processing agent (D), and in that said first lid (12) is operable when moved to its closed position to effect opening of said second lid (33) to permit access from within said first housing (11) to within the smaller housing (32).

6. A machine according to claim 1 or 2 or 5 characterized in that said electric motor means comprises a single electric motor operable to effect said winding operation and said rewinding operation.

* * * * *